US006477802B2

(12) United States Patent
Baer, Sr.

(10) Patent No.: US 6,477,802 B2
(45) **Date of Patent: *Nov. 12, 2002**

(54) EXTENDED DUST COVER FOR A HANDGUN

(76) Inventor: Les C. Baer, Sr., 29601 34th Ave. North, Hillsdale, IL (US) 61257

( * ) Notice: Subject to any disclaimer, the term of this patent is extended or adjusted under 35 U.S.C. 154(b) by 0 days.

This patent is subject to a terminal disclaimer.

(21) Appl. No.: 09/992,319

(22) Filed: Nov. 19, 2001

(65) Prior Publication Data

US 2002/0073596 A1 Jun. 20, 2002

Related U.S. Application Data

(63) Continuation of application No. 09/347,312, filed on Jul. 2, 1999, now Pat. No. 6,345,463.

(51) Int. Cl.[7] ..... F41C 27/00
(52) U.S. Cl. ..... 42/97; 42/71.01
(58) Field of Search ..... 42/97, 71.02, 75.03

(56) References Cited

U.S. PATENT DOCUMENTS

| | | | | | |
|---|---|---|---|---|---|
| 580,924 | A | | 4/1897 | Browning | 42/7 |
| 788,404 | A | * | 4/1905 | Hirst | 42/135 |
| 2,140,945 | A | | 12/1938 | Swartz | 42/1 |
| 2,240,681 | A | | 5/1941 | Swartz | 42/1 |
| 2,259,569 | A | * | 10/1941 | King | 42/1.06 |
| 2,464,010 | A | * | 3/1949 | Vonella | 42/1.06 |
| 2,627,686 | A | * | 2/1953 | Shockley | 42/1.06 |
| 2,705,847 | A | | 4/1955 | Kramer | 42/7 |
| 2,744,448 | A | | 5/1956 | Allen | 89/196 |
| 3,110,223 | A | | 11/1963 | Schlappich | 42/7 |
| 3,163,951 | A | * | 1/1965 | Lewis | 42/59 |
| 3,340,641 | A | | 9/1967 | Recker | 42/97 |
| 3,365,829 | A | | 1/1968 | Shockey | 42/97 |
| 3,491,650 | A | | 1/1970 | Rohr | 42/7 |
| 3,604,136 | A | * | 9/1971 | Edwards | 42/97 |
| 3,724,326 | A | | 4/1973 | Day | 42/77 |
| D275,123 | S | | 8/1984 | Nilsson | 42/97 |
| 4,709,497 | A | | 12/1987 | Resca | 42/75.02 |
| 4,715,140 | A | | 12/1987 | Rosenwald | 42/97 |
| 4,726,136 | A | | 2/1988 | Dornaus et al. | 42/70.08 |
| 5,293,708 | A | | 3/1994 | Strayers et al. | 42/75.03 |
| 5,305,678 | A | | 4/1994 | Talbor et al. | 89/14.3 |
| 5,423,145 | A | * | 6/1995 | Nasset | 42/75.01 |
| 5,615,505 | A | | 4/1997 | Vaid | 42/7 |
| 5,628,134 | A | | 5/1997 | Wesp et al. | 42/7 |
| 5,675,106 | A | | 10/1997 | Leiter | 42/7 |
| 6,345,463 | B1 | * | 2/2002 | Baer, Sr. | 42/7 |

* cited by examiner

*Primary Examiner*—Michael J. Carone
*Assistant Examiner*—Denise J Buckley
(74) *Attorney, Agent, or Firm*—Woodard, Emhardt, Naughton, Moriarty & McNett

(57) ABSTRACT

A handgun assembly is provided. The frame of the handgun includes a forwardly extending portion that terminates at the forward end of the muzzle or slide of the handgun. The forwardly extending portion of the frame has a dust cover that supports the entire length of the slide, and provides for the assembly of the standard handgun components therein. The frame provides additional weight forwardly displaced from the hand of the shooter, providing better feel and balance to the handgun and reducing muzzle flip.

7 Claims, 5 Drawing Sheets

EXTENDED DUST COVER FOR A HANDGUN

CROSS-REFERENCE TO RELATED APPLICATION

This application is a continuation of U.S. patent application Ser. No. 09/347,312, filed Jul. 2, 1999 now U.S. Pat. No. 6,345,463.

BACKGROUND OF THE INVENTION

The present invention relates generally to handguns, and more particularly to an improved assembly for a handgun.

Auto-loading, automatic, and semi-automatic handguns have been in use for many years in the United States and throughout the world. Handguns are used by law enforcement personnel, military personnel, and individuals for many purposes, including self-defense, target shooting, and sport shooting, to name a few. One of the more popular models for auto-loading handguns is found in the commonly referred to Model 1911 .45 caliber handgun (M-1911). Versions of the M-1911 have been around since the early twentieth century. The M-1911 has been the official sidearm of the armed forces of the United States and various law enforcement agencies. Due to its popularity and effectiveness, the design of the M-1911 has continued to evolve and develop since its original design to satisfy the need for a more reliable and accurate weapon and to provide its users various features. For example, design changes have incorporated shorter barrels, frames made from materials such as aluminum or polymers, and improved safety features, just to name a few.

One problem associated with M-1911's and other large caliber handguns is apparent to users who compete in sport shooting. When competing in sport shooting competitions, it is particularly desirable to be able to accurately fire multiple rounds in rapid succession. With large caliber handguns, the muzzle has a tendency to "flip" upon firing of a round. This muzzle flip, caused by the recoil force of the slide, makes it more difficult for the shooter to shoot accurately and to quickly re-sight the target after firing a round. Thus, the user must either sacrifice accuracy or rapidity, or both, when using a large caliber weapon. Muzzle flip and felt recoil is also a problem for law enforcement personnel and others using large caliber weapons for law enforcement or self-defense.

To address concerns regarding muzzle flip and recoil, some users revert to smaller caliber weapons. These smaller caliber weapons use cartridges have considerably less knockdown force than a .45 caliber cartridge. Thus, the power and effectiveness of the handgun is sacrificed for increased accuracy. Other users attach compensators to the forward end of the barrel to address muzzle flip. One example of such a compensator is found in U.S. Pat. No. 4,715,140 to Rosenwald. Compensators have the drawbacks of increasing the barrel length, disturbing the balance of the handgun, adding components to the handgun assembly, and adding cost for the user.

There have also been prior patents that have addressed various aspects of the design and operation of M-1911 handguns. For example, in U.S. Pat. No. 5,293,708 to Strayer et al., there is discussed a frame and handgrip assembly for the M-1911 handgun with a gripless frame for supporting the slide and firing components of a standard M-1911, and a handgrip structure coupled to the gripless frame structure.

In U.S. Pat. No. 4,709,497 to Resca, there is discussed a handgun frame for an improved barrel bushing extending forwardly from the end of the barrel that supports the barrel within the slide independently of the recoil spring assembly. The frame includes an elongated cantilevered support extending forwardly to a position beyond the forward end of the barrel to rigidly mount a barrel bushing thereon. The frame and bushing are designed to address problems associated with the interface and assembly of the frame, slide, barrel, and barrel bushing in standard M-1911 handguns.

While the above illustrates that there have been various approaches to improving the operation and assembly handguns, there remains a need for additional improvement. There is needed a handgun assembly that addresses the problems in the prior art in a reliable, safe and efficient manner. The present invention satisfies these needs, among others.

SUMMARY OF THE INVENTION

The present invention provides a handgun assembly having a slide and a frame, the frame having a forwardly extending portion that supports substantially the entire length of the slide.

According to one aspect of the invention, a method for assembling a handgun is provided. The method includes providing a frame that has a handgrip portion, a firing component receiving portion, and a forwardly extending portion. The forwardly extending portion includes a dust cover with a length extending to a forward end of the frame. There are also provided components for attachment to the frame. The components include a slide with a main body portion body extending between a rearward end and a forward end. The slide is positioned on the frame so that the forward end of the slide is substantially coextensive with the forward end of the frame.

In one form, the slide has a pair of bearing surfaces extending along the main body portion to the forward end of the slide. The frame has a dust cover with a u-shaped bottom having a thickness defined between an outer wall and an inner bearing surface. The u-shaped bottom extends between a pair of opposite side rails, and each side rail has a support surface extending along the length of the dust cover to the forward end of the frame. The slide is positioned so that the bearing surfaces of the slide engage the support surfaces of the dust cover to support the slide.

In another form, the components provided include a slide with a recoil spring assembly receiving portion having a length. The slide is positioned on the frame so that the recoil spring receiving portion is supported on the bearing surface of the u-shaped bottom of the dust cover along its entire length.

In another aspect of the present invention, a handgun assembly is provided. The handgun assembly includes a frame configured for receiving and supporting components of a handgun. The components include a slide with a main body portion having a length extending between a forward end of the slide and a rearward end of the slide. The slide further includes a recoil spring receiving portion extending from its forward end rearwardly along a portion of its length. The frame includes a forwardly extending portion that has a dust cover with a forward end coextensive with the forward end of the slide when the handgun is assembled. The frame also includes a firing component receiving portion coupled to the forwardly extending portion, and a handgrip portion coupled to the firing component receiving portion.

In one form, the firing component receiving portion includes a trigger guard. The trigger guard has a forward circular portion with a radius measured from a first center R1 and a rearward circular portion with a radius measured from a second center R2. The forward end of the frame is located about 4.22 inches from the first center R1.

In another aspect of the invention, a handgun assembly for reducing muzzle flip is provided. The handgun assembly includes a frame with a forward end and a forwardly extending portion that extends rearwardly from the forward end. There is also a slide that is mountable on the frame. The slide has a main body portion that extends between a forward end and a rearward end, wherein the forward end of said frame is coextensive with the forward end of the slide.

In one form of the handgun assembly, the forwardly extending portion of the frame has a weight and includes a dust cover extending rearwardly from the forward end of the frame. The dust cover includes a length and a substantially u-shaped bottom with a thickness along the length defined between an inner bearing surface and an outer surface. In another form, the thickness of the u-shaped bottom may be increased along the length to increase the weight of the forwardly extending portion of the handgun assembly.

These and other objects and advantages of the present invention will be apparent from the following description of the preferred embodiment.

DESCRIPTION OF THE PREFERRED EMBODIMENT

Figure 1:
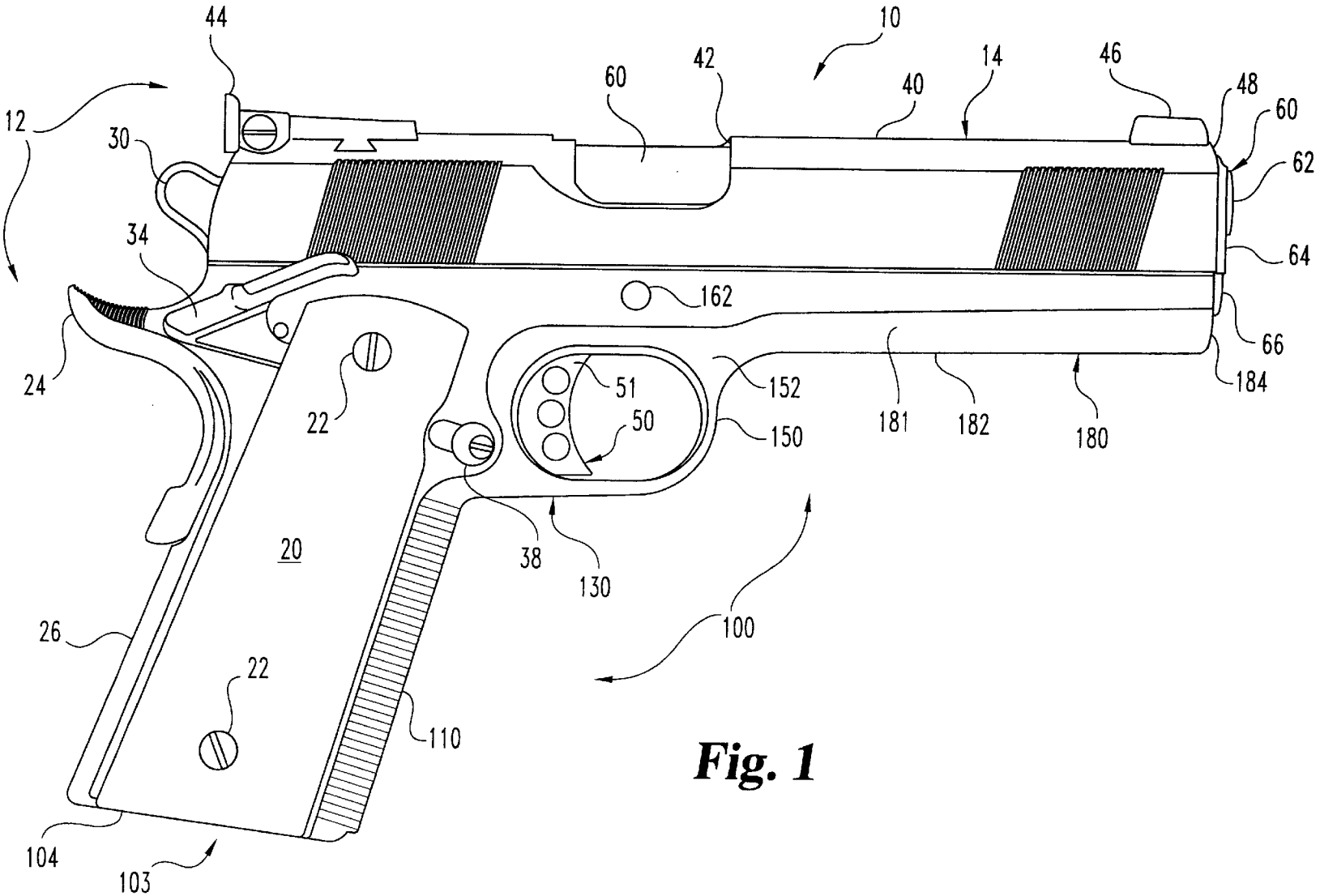
FIG. 1 is right elevational view of an M-1911 handgun according to one aspect of the present invention.
Figure 2:
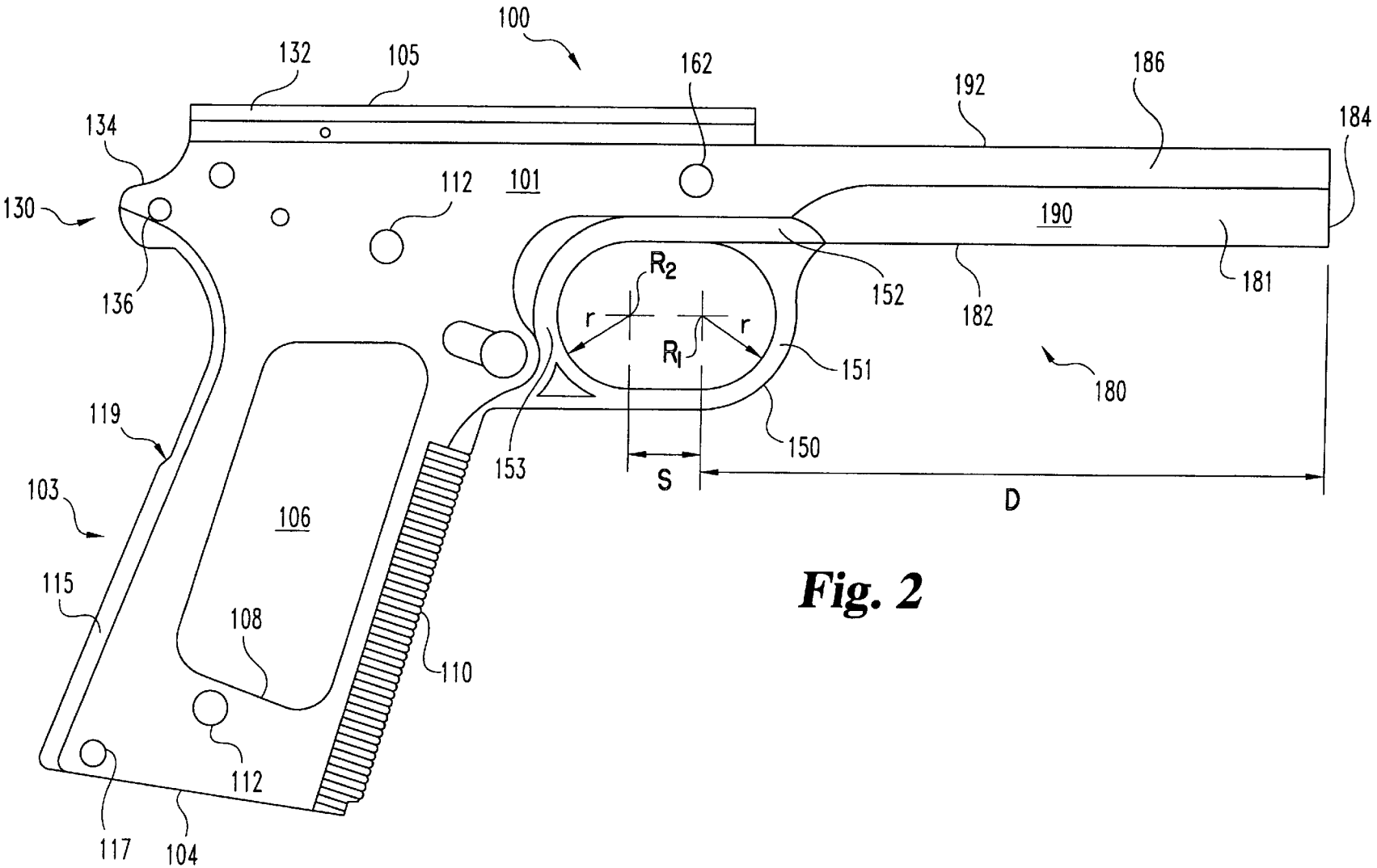
FIG. 2 is a right elevation view of a frame forming part of the handgun of FIG. 1.
Figure 3:
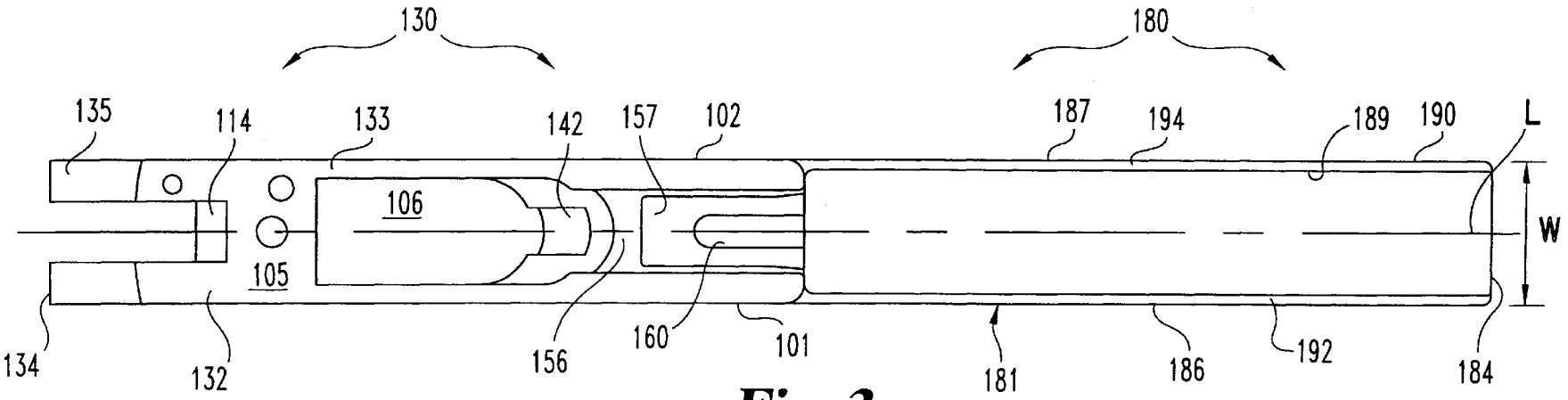
FIG. 3 is a top plan view of the frame of FIG. 2.

For the purposes of promoting an understanding of the principles of the invention, reference will now be made to the embodiment illustrated in the drawings and specific language will be used to describe the same. It will nevertheless be understood that no limitation of the scope of the invention is thereby intended. Any such alterations and further modifications in the illustrated device, and any such further applications of the principles of the invention as illustrated therein are contemplated as would normally occur to one skilled in the art to which the invention relates.

In FIG. 1 there is illustrated an M-1911 handgun 10 according to one aspect of the present invention. While the preferred embodiment is directed to an M-1911 handgun, it is believed that the principles of the present invention have application with other types and models of handguns as well. The handgun 10 includes a muzzle portion 14 and a plurality of components 12 coupled to and/or within a frame 100. Frame 100 includes a handgrip portion 103, a firing component receiving portion 130, and a forwardly extending portion 180. Preferably the portions of frame 100 are formed from a single piece of metal, such as stainless steel or aluminum. Other materials, such as high strength polymers, are also contemplated. Throughout the description that follows, the various portions of handgun 10 will be designated as rearward or forward. The rearward portion of handgun 10 is that part of the gun and/or frame extending towards handgrip portion 103. The forward part of handgun 10 is that portion of the gun and/or frame extending towards the forwardly extending portion 180, which includes the end of the muzzle 14 for discharging a bullet fired from the gun.

Many of the various components 12 assembled to frame 100 are generally found on conventional M-1911 handguns, and are well known to those skilled in the art. Thus, reference in the following discussion regarding handgun 10 will not necessarily be made to each and every component 12 forming a part of the handgun 10.

The components 12 include a stock 20 coupled to handgrip portion 103 of frame 106 via stock screws 22. Also coupled to handgrip portion 103 is main spring housing 26, which encloses a main spring (not shown). Handgrip portion 103 includes a plurality of serrations 110 on its forward side to facilitate gripping of handgun 10. A bottom 104 of handgrip portion 103 defines an opening for a cartridge magazine (not shown).

The firing component portion receiving 130 includes a grip safety 24 coupled thereto and protruding rearwardly from the frame 100. A hammer 30 is positioned above grip safety 24. Side release lever 34 extends forwardly from grip safety 24, and is provided to facilitate disassembly of handgun 10. A magazine catch assembly 38 is provided to retain the magazine disposed within handgrip portion 103. As is well-known in the art, the magazine retains a plurality of cartridges and automatically loads the cartridges into the firing chamber of the handgun 10 as each round is fired.

In order to fire cartridges from the handgun 10, a trigger assembly 50 is provided within the receiving portion 130. Trigger assembly 50 includes a finger-engaging portion 51 disposed within the trigger guard 150 of frame 100. Finger engaging portion 51 is pulled rearwardly within trigger guard 150, as is well known in the art, to actuate hammer 30 and a firing pin assembly within the receiving portion 130 to repeatedly fire cartridges from the handgun 10. An ejector assembly (not shown) within receiving portion 130 ejects the spent cartridge through cartridge ejection opening 42 in order to allow chambering of another cartridge.

Coupled to the top of frame 100 along firing component receiving portion 130 and forwardly extending portion 180 is a slide 40. Slide 40 defines the cartridge ejection open 42 for ejecting spent cartridges as described above. A barrel 60 is partially exposed through opening 42. A rear sight 44 is mounted on top of slide 40 at the rearward end of the handgun 10. A forward sight 46 is mounted at the forward end of a slide 40. At the forward end 48 of slide 40, there projects a forward end 62 of barrel 60. Barrel 60 is retained in position within slide 40 via barrel bushing 64. Preferably, bushing 64 is a stainless steel bushing. Barrel 60 and bushing 64 each have any one of a shape, length and/or configuration that are well-known in the art.

The forwardly extending portion 180 of frame 100 includes a dust cover or trough 181 extending from thickened portion 152 of trigger guard 150 to forward end 184. Trough 181 houses a recoil spring assembly 70 (FIG. 7*a*) positioned below the barrel 60. The function, operation, and components of the recoil spring assembly 70 are well known in the art. A plug 66 of the recoil spring assembly is positioned at the forward end 184 of the frame 100. The recoil spring assembly acts to transmit the recoil force created by firing the handgun 10 from the slide 40 to the frame 100. Frame 100 also defines an aperture for receiving a slide stop pin 162. Slide stop 162 engages a portion of a slide stop/plunger assembly (not shown), positioned on the left-hand side of the handgun 10 to the frame 100.

With reference now to FIGS. 2–6, description of frame 100 will now be made in view of the embodiments illustrated therein. The frame 100 is depicted in FIGS. 1–6 with the various components 12 and muzzle 14 removed therefrom. Frame 100 has a width "W" (FIG. 3) defined by a first sidewall 101 and a second sidewall 102. Sidewalls 101, 102 extend from the forward portion 184 of the frame 100 to and including the handgrip portion 103. The sidewalls 101, 102 also extend from the top 105 of the frame 100 to the bottom 104 of handgrip portion 103. The sidewalls 101, 102, define the outer most limits of the width "W" of the frame 100.

As discussed above with respect to FIG. 1, frame 100 includes handgrip portion 103, firing component receiving portion 130, and forwardly extending portion 180. Handgrip portion 103 includes a bottom 104 defining a through-hole allowing the magazine and cartridges to be inserted into a receptacle 106. Receptacle 106 is defined between walls 101, 102 of the frame 100, and extends from bottom 104 to top 105.

The forward portion of handgrip portion 103 defines a serrated surface 110 to facilitate gripping of the handgun 10 during firing. Edge 108 of handgrip portion 103 defines an aperture through wall 101 (similarly an aperture is formed in wall 102) in communication with receptacle 106. Removal of material to form the aperture in walls 101, 102 decreases the weight of handgrip portion 103 of the frame 100. Stock screw apertures 112 are formed through walls 101, 102 to receive stock screws 22 to mount stock 20 to handgrip portion 103.

Figure 4:
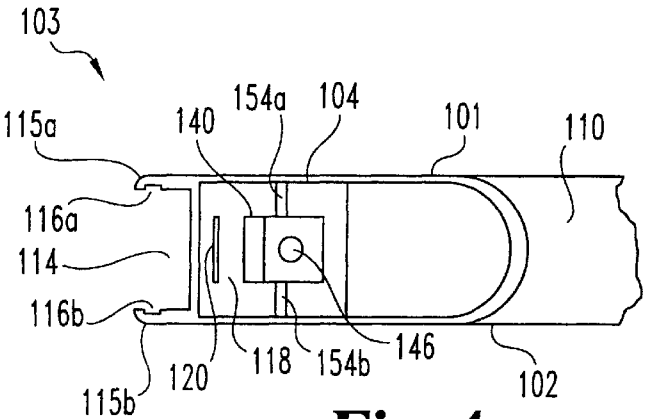
FIG. 4 is a bottom plan view of the handgrip portion of the frame of FIG. 2.
Figure 5:
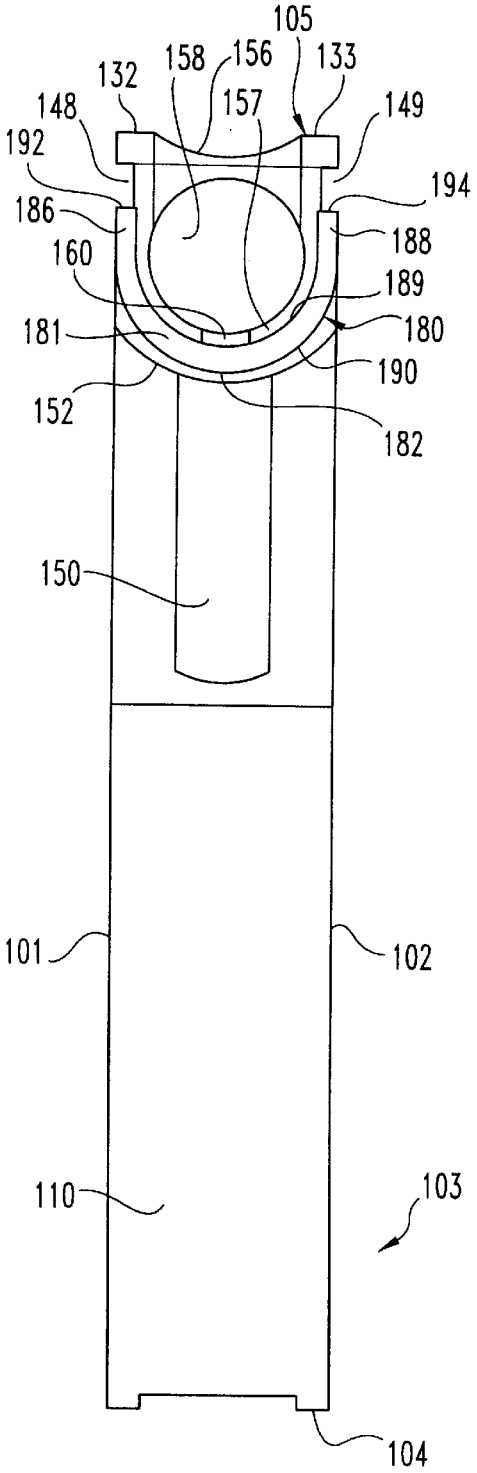
FIG. 5 is a right end view of the frame of FIG. 2.
Figure 6:
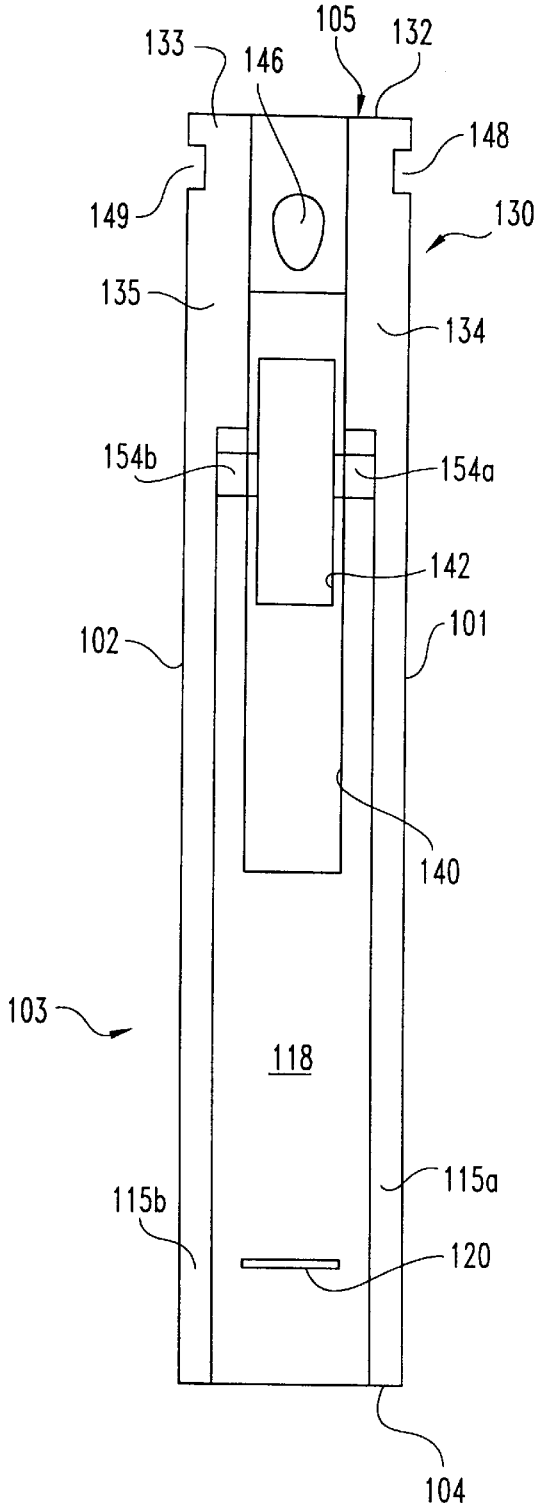
FIG. 6 is a left end view of the frame of FIG. 2.

Side rails 115*a* and 115*b* are provided on the rearward end 119 of handgrip portion 103 (FIG. 4). Side rails 115*a*, 115*b* each define a vertically oriented groove 116*a*, 116*b*, respectively, for slidingly receiving a mainspring housing 26. The main spring housing 26 along with its components, including the main spring, are slidingly received within a channel 114 formed between side rails 115*a* and 115*b*. Aperture 117 is provided through frame 100 adjacent bottom 104 to receive a pin to couple the main spring housing to the frame 100. Frame 100 also includes a rear wall 118 that defines a portion of channel 114 (FIG. 6). A sear spring and its various components (not shown) are received between the main spring housing and the rear wall 118. A slit 120 communicating with receptacle 106 is provided in the rear wall 118.

Firing component receiving portion 130 includes a first guide rail 132 and a second guide rail 133 adjacent top 105. Guide rails 132 and 133 define grooves 148, 149, respectively extending along the length of the guide rails. Guide rails 132, 133 are configured to slidingly receive and retain a slide, such as the slide 40. Receiving portion 130 also includes rearward projections 134, 135. Projections 134, 135 define an aperture 136 for receiving a pin to couple side release lever 34 to frame 100. A slot 138 is formed between rearward projections 134, 135, the slot 138 being in communication with channel 114.

Rear wall 118 defines a rear passage 140 communicating with receptacle 106. A forward passage 142 is defined in a rearward portion 153 of trigger guard 150. Forward passage 142 is also in communication with receptacle 106 and aligned with a portion of rear passage 140, as shown in FIG. 6. Horizontally oriented slots 154*a*, 154*b* are provided within receptacle 106 and communicate between passages 140, 142 to facilitate vertical alignment of the trigger assembly 50. The passages 140, 142 and slots 154*a*, 154*b* allow placement of a trigger assembly, such as the assembly 50, within the receiving portion 130.

An aperture 146 for receiving a disconnector pin is provided through the top 105 of frame 100 and in communication with receptacle 106. A thickened portion 152 is provided at the interface between trough 181 and trigger guard 150. Between guide rails 132, 133 and below the top 105 there is provided recessed surface 156 which is shaped to conform to the underside of the cartridge positioned for firing from handgun 10.

A housing 157 for receiving a rearward portion of the recoil spring assembly 70 (FIG. 7*a*) is positioned forward of the receptacle 106 and above trigger guard 150. The housing 157 includes recoil spring bearing surface 158. Bearing surface 158 abuttingly engages the guide 74 at the rearward end of the recoil spring assembly 70 and resists rearward displacement of the recoil spring assembly 70 when the handgun 10 is fired. It should be understood that the recoil spring assembly 70 is substantially completely housed within the dust cover 181. A groove 160 is provided in a bottom portion of the housing 157 for receiving the guide 74 of the recoil spring assembly 70.

Forwardly extending portion 180 includes a trough or a dust cover 181 extending from thickened portion 152 of trigger guard 150 to forward end 184 of the frame 100. Dust cover 181 includes a bottom 182 that is formed into a substantially u-shaped configuration and has a thickness defined between an inner bearing surface 189 and outer surface 190. The upper portion of the dust cover includes a pair of laterally extending side rails 186, 188 that extend from a corresponding end of the substantially u-shaped bottom 182. Preferably, side rails 186, 188 extend vertically from the bottom portion 182 to form a corresponding part of the sidewalls 101, 102 along the length D of dust cover 181. The side rails 186, 188 each include a support surface 192, 194, respectively, at the top of the dust cover 181 extending from forward end 184 to guide rails 132, 133.

In its most preferred form, the frame 100 has a forwardly extending portion 180 with a forward end 184 substantially coextensive with the forward end 48 of the slide 40, as shown in FIG. 1. In one preferred embodiment, the dust cover or trough 181 extends about 1.625 inches beyond a forward end of a dust cover of a conventional M-1911 frame. In another preferred embodiment, the forward portion 151 and rearward portion 153 of the trigger guard 150 are defined by circular portions having a radius "r" measured from centers R1 (forward portion) and R2 (rearward portion), respectively. The centers R1 and R2 are spaced by a distance "s," which is about 0.42 inches. The dust cover 181 has a length "D" measured with forward end 184 positioned about 4.22 inches from the radius R1 of the trigger guard 150.

Figure 7:
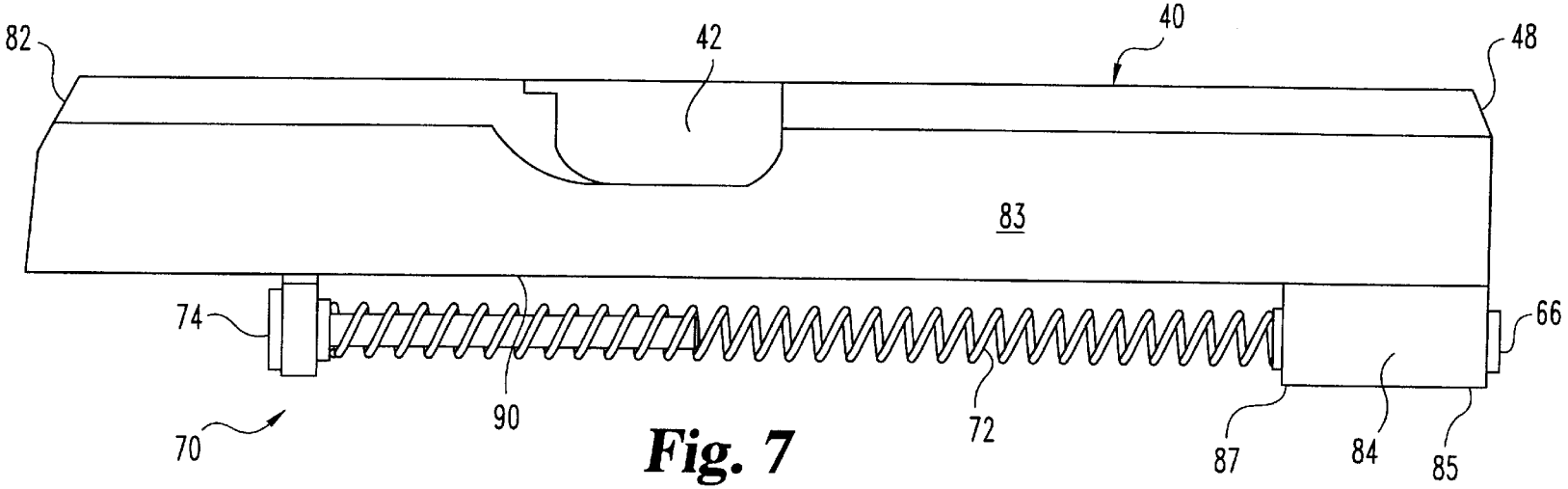
FIGS. 7—7*a* are a right elevation view and an end view, respectively, of a slide and recoil spring assembly mountable to the frame of FIG. 2.
Figure 7A:
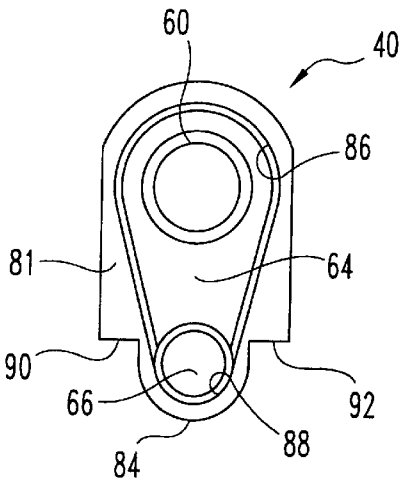

Referring now to FIGS. 7*a*–7*b*, there is illustrated a preferred embodiment slide 40 and recoil spring assembly 70 engageable to the frame 100 of the present invention. Recoil spring assembly 70 includes a plug 66, a recoil spring 72, and a guide 74. Plug 66 receives the forward end of the recoil spring 72, and guide 74 is positioned within the rearward end of recoil spring 72.

Slide 40 includes aperture 42 for ejecting cartridges, and an upper body portion 83 extending between forward end 48 and rearward end 82. At forward end 48 there is provided a recoil spring assembly receiving portion 84 extending below the slide 40. Preferably, the recoil spring receiving portion 84 is integrally formed with the upper body portion 83 of the slide 40. Recoil spring receiving portion 84 has a forward end 85 aligned with and coextensive with the forward end 48 of slide 40. The recoil spring receiving portion 84 extends rearward along the length of slide 40 to its rearward end 87. Recoil spring receiving portion 84 defines a recoil spring receiving chamber 88 and slide 40 defines a barrel/bushing chamber 86. When the handgun 10 is assembled, the recoil spring plug 66 is positioned within receiving chamber 88, and the barrel 60 and barrel bushing 64 are positioned within barrel/bushing chamber 86. Bushing 64 maintains the position of the barrel 60 at the forward end 48 of the slide 40, and abuts against the recoil spring plug 66.

Bearing surfaces 90, 92 are provided along the length of slide 40 along the bottom of upper body portion 83. Bearing surfaces 90, 92 are configured to mate with supporting surfaces 192, 194 when the slide 40 is assembled to frame 100. Thus, the support surfaces 192, 194 extend the entire length of bearing surfaces 90, 92 of the slide 40 to forward end 48.

When assembling the handgun 10, the barrel 60 and bushing 64 are placed within the slide 40 such that forward end 62 of barrel 60 and the bushing 64 are at the forward end 48 of the slide 40. The recoil spring assembly 70 is placed within the dust cover 181 such that the recoil spring guide 74 at the rear of the recoil spring assembly 70 is positioned in guide housing 157 and abuts against abutment surface 156. A forward end of the recoil spring plug 66 is positioned at the forward end 184 of the dust cover 181, and extends rearwardly to engage the recoil spring 72, and the length of the entire recoil spring assembly 70 is fully supported the dust cover 181. However, plug 66 is accessible at the forward end ends 48, 184 of the slide 40 and frame 100 for disassembly of the handgun 10.

In the prior art, the nearly the entire length of the recoil spring receiving portion 84 is exposed, and substantially the entire length of receiving portion 84 cantilevers from the forward end of prior art dust covers. Alternatively, the recoils spring plug is not accessible. In the handgun 10, the length of recoil spring assembly 70, including plug 66, and the receiving portion 84, are fully enclosed by and supported by the dust cover 181, while providing access to the forward end of the plug 66 for disassembly.

The forwardly extending portion 180 and dust cover 181 support slide 40 along support surfaces 192, 194 and guide rails 132, 133 for substantially the entire length of the slide 40. As shown in FIG. 1, the forward end 184 of the dust cover 181 and the support surfaces 192,194 extend to forward end 48 of slide 40. In the prior art, the slide cantilevers beyond the forward end of the frame. The forwardly extending portion 180 also supports the bushing 64 mounted within slide 40 for holding the barrel 60 in position within the slide 40. In order to provide for the assembly of these components within the forward end 184 of the trough 180, tolerances in the fabrication of the trough 181 must be maintained within very tight limits.

Many advantages are realized by a handgun assembly using the frame 100. For example, by extending forward end 184 of the dust cover 181 to be coextensive with forward end 48 of the slide 40, the slide 40 is fully supported along its length. This provides stability and reliability to the handgun 10. The extra length of the dust cover 181 also makes it easier to assemble the handgun 10 by eliminating components that cantilever beyond the end of the dust cover as the handgun is assembled.

Another advantage realized is that the dust cover 181 provides additional weight forwardly displaced from the hand of the shooter without additional length or components being added to the handgun 10. This additional weight changes the center of gravity of the handgun 10 to give it a better feel and balance in the hand of the shooter before and during firing. The additional weight provided by extended length of the dust cover 181 also reduces muzzle flip of the handgun 10, providing for greater accuracy and less time in re-sighting the target. The amount of recoil felt by the shooter is also reduced by moving the center of gravity further forward of the hand.

The extended length of the dust cover 181 provides a handgun assembly that allows the gun manufacturer to add weight in addition to the weight provided by extending the length of the dust cover 181 alone. For example, increasing the thickness of bottom 182 of dust cover 181 between surfaces 189, 190 provides additional weight balanced along the centerline of the handgun 10. The additional weight is also evenly distributed along the length D of the dust cover 181. In one embodiment, the weight of the frame 100 is increased by 3.5 ounces over the standard frame weight by increasing the length and thickness of dust cover 181. Whether the additional weight is from increased length alone or a combination of increased length and thickness of bottom 182, the additional weight is forwardly displaced and balanced along the centerline of the handgun. This results in a heavier gun without the burden and expense of adding separate or additional components, such as compensators, barrel extensions, and the like.

In addition to allowing standard components of a handgun to be used in the assembly with the frame 100, the frame 100 provides extra protection to the components. The dust cover 181 better protects recoil spring assembly of the handgun 10 from dust and other contaminants since the recoil spring assembly is fully enclosed along its length.

While the invention has been illustrated and described in detail in the drawings and foregoing description, the same is to be considered as illustrative and not restrictive in character, it being understood that only the preferred embodiment has been shown and described and that all changes and modifications the come within the spirit of the invention are desired to be protected.

What is claimed is:

1. A handgun, comprising:

a frame, the frame configured for receiving and supporting components of the handgun assembled thereto, said components including a slide with a main body portion having a length extending between a forward end of said slide and a rearward end of said slide, said slide further including a recoil spring receiving portion extending from said forward end rearwardly along a portion of said length of said slide, said frame including:

a forwardly extending portion of said frame having a weight distribution and having a dust cover with a forward end coextensive with the forward end of said slide when the handgun is assembled;

a firing component receiving portion coupled to said forwardly extending portion, wherein said firing component receiving portion includes a trigger guard, said trigger guard having a forward circular portion with a radius measured from a first center R1 and a rearward circular portion with a radius measured from a second center R2, said forward end of said frame being located about 4.22 inches or less from said first center R1 to increase said weight distribution of said forwardly extending portion; and a handgrip portion coupled to said firing component receiving portion.

2. The handgun of claim 1, wherein said dust cover includes a u-shaped bottom portion, said bottom portion having a thickness defined between an inner bearing surface and an outer surface, said length of said recoil spring receiving portion being fully supported by said bearing surface.

3. The handgun of claim 2, wherein said frame further includes a pair of side rails extending from a corresponding end of said u-shaped bottom, each of said side rails has a top defining a bearing surface, said bearing surfaces configured to engage a portion of said slide at least at said forward end of said slide.

4. The handgun of claim 1, further comprising a barrel having a muzzle end that is coextensive with said forward end of said frame and said forward end of said slide.

5. The handgun of claim 1, wherein said forward end of said frame is spaced 4.22 inches from said center R1.

6. The handgun of claim 1, wherein said forwardly extending portion, said firing component receiving portion, and said handgrip portion are machined from a single piece of metal.

7. The handgun of claim 3 wherein said dust cover has a thickness between an inner bearing surface and an outer surface that increases along said length.

* * * * *